US007699211B2

(12) United States Patent
Holloway

(10) Patent No.: US 7,699,211 B2
(45) Date of Patent: Apr. 20, 2010

(54) TRIANGULAR CONTAINER WITH PREGLUED ENDS

(75) Inventor: Stephen J. Holloway, Baltimore, OH (US)

(73) Assignee: Buckeye Boxes, Inc., Columbus, OH (US)

( * ) Notice: Subject to any disclaimer, the term of this patent is extended or adjusted under 35 U.S.C. 154(b) by 0 days.

(21) Appl. No.: 12/237,427

(22) Filed: Sep. 25, 2008

(65) Prior Publication Data

US 2010/0072265 A1 Mar. 25, 2010

(51) Int. Cl.
*B65D 5/08* (2006.01)
*B31B 1/26* (2006.01)
*B31B 1/62* (2006.01)

(52) U.S. Cl. ..... 229/115; 229/138; 493/121; 493/128; 493/156; 493/183

(58) Field of Classification Search ..... 229/115, 229/186, 138; 493/121, 128, 156, 157, 183
See application file for complete search history.

(56) References Cited

U.S. PATENT DOCUMENTS

| | | | | | |
|---|---|---|---|---|---|
| 1,221,785 | A | | 4/1917 | Williams | |
| 1,833,419 | A | | 11/1931 | Grossen | |
| 1,897,143 | A | | 2/1933 | Powell | |
| 1,933,643 | A | * | 11/1933 | Tanner | 229/115 |
| 2,349,589 | A | * | 5/1944 | Harrington | 229/115 |
| 2,421,748 | A | * | 6/1947 | Fink | 229/115 |
| 3,199,765 | A | * | 8/1965 | Locke | 229/115 |
| 3,482,760 | A | | 12/1969 | Pascus et al | |
| 3,653,576 | A | * | 4/1972 | Stranicky | 229/115 |
| 4,202,485 | A | * | 5/1980 | Fremion | 229/112 |
| 4,548,323 | A | | 10/1985 | Rekow | |
| 5,503,325 | A | | 4/1996 | Nelson et al. | |
| 5,522,538 | A | * | 6/1996 | Gray | 229/186 |
| 6,123,254 | A | * | 9/2000 | Dupuis | 229/115 |
| 6,283,405 | B1 | | 9/2001 | Tracy | |
| 6,926,196 | B2 | | 8/2005 | Testerman et al. | |
| 7,347,326 | B2 | | 3/2008 | Baechle | |
| 2003/0006273 | A1 | | 1/2003 | Tsern et al. | |
| 2006/0151586 | A1 | * | 7/2006 | Kao | 229/186 |
| 2006/0169754 | A1 | | 8/2006 | Tseng | |
| 2007/0000979 | A1 | * | 1/2007 | West | 229/115 |

FOREIGN PATENT DOCUMENTS

| | | | | |
|---|---|---|---|---|
| FR | 2581364 | A1 * | 11/1986 | 229/115 |

* cited by examiner

*Primary Examiner*—Gary E Elkins
(74) *Attorney, Agent, or Firm*—Kremblas Foster Intellectual Property

(57) ABSTRACT

A substantially planar shipping container blank is configured for planar stacking to permit compact packaging but simplifies the ease of assembly into a triangular shipping container. The container blank is foldably divided into a rectangular longitudinal section, two end sections, and a closure tab. The interior surfaces of certain portions of the end sections are pre-mounted to the interior surface of the longitudinal section. By folding the longitudinal section of the blank along two pre-pressed longitudinal fold lines, the end sections of the blank automatically fold along pre-pressed angular fold lines to form a triangular shipping container. The container can thereafter be fastened shut by folding the closure tab along a third pre-pressed longitudinal fold line and affixing the tab to the exterior of the container.

5 Claims, 10 Drawing Sheets

FIG. 2a
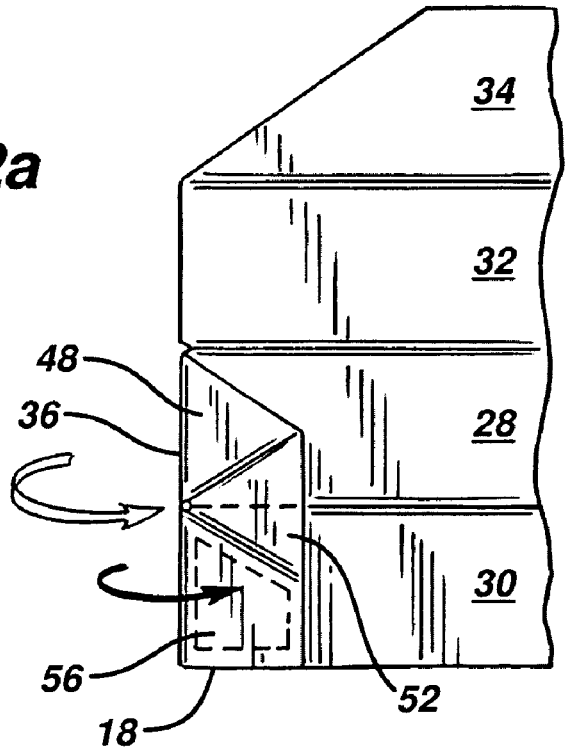
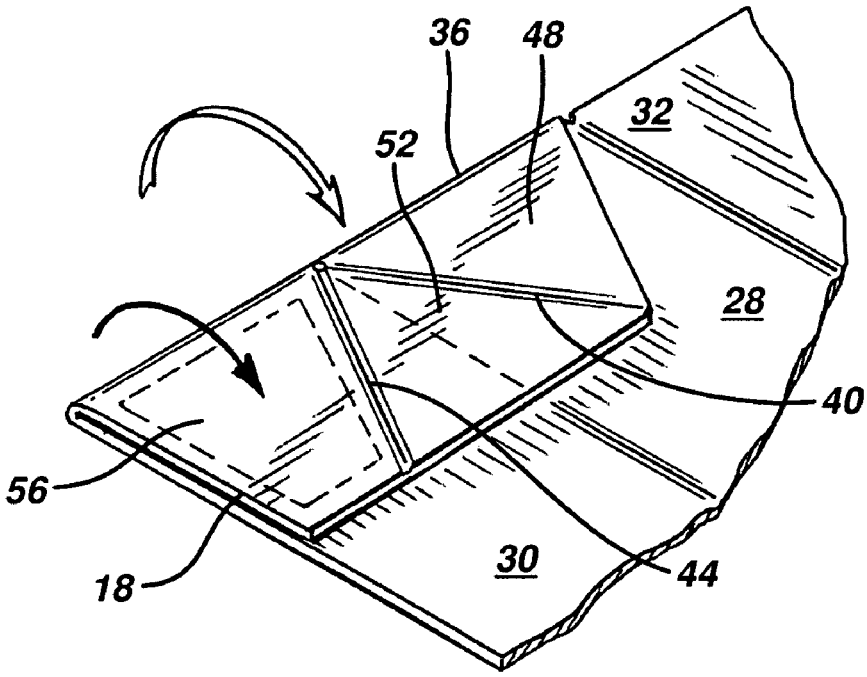
FIG. 2b

FIG. 4a
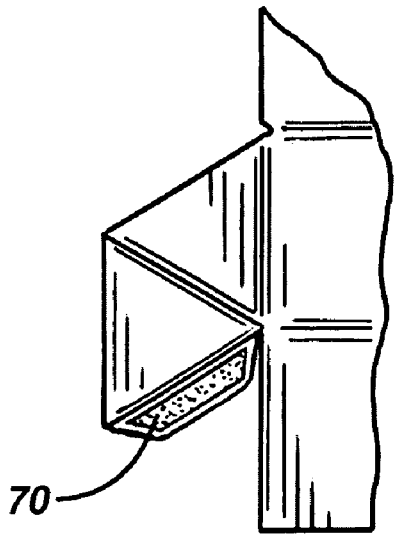
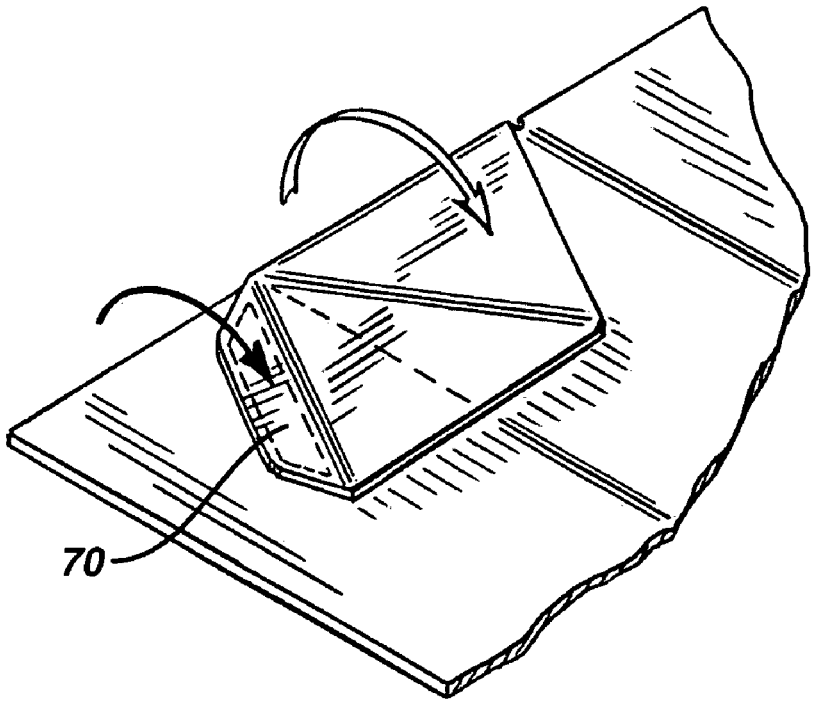
FIG. 4b

FIG. 5a
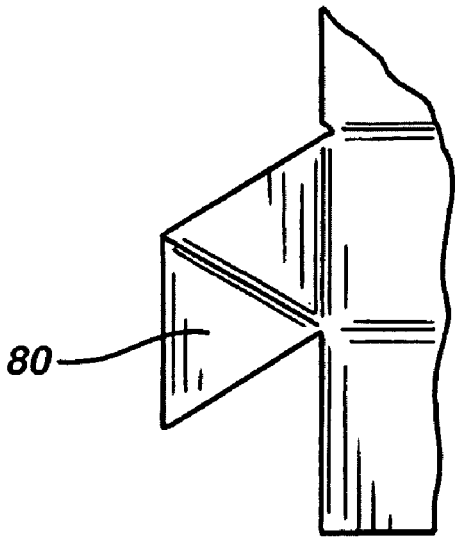
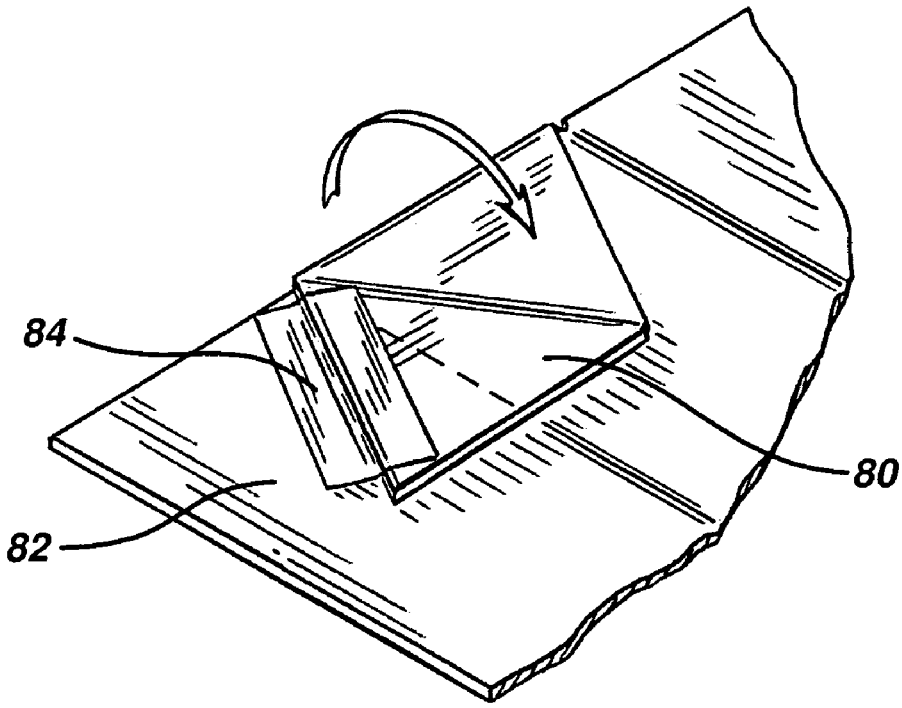
FIG. 5b

FIG. 7a
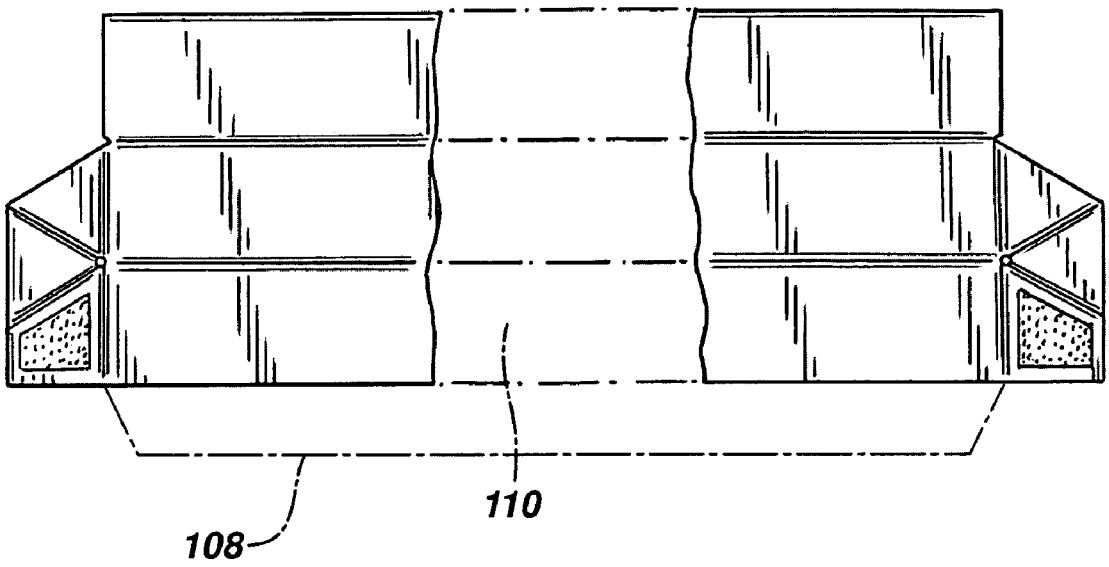
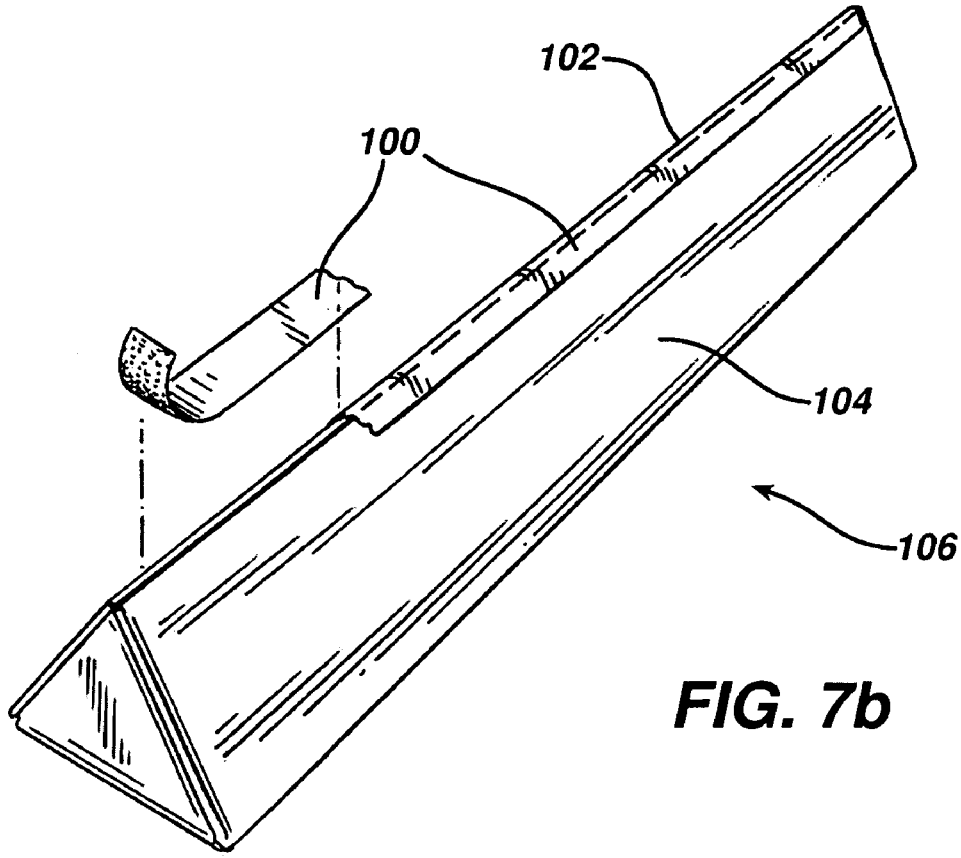
FIG. 7b

TRIANGULAR CONTAINER WITH PREGLUED ENDS

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to the field of shipping containers and relates more particularly to a shipping container blank that is configured for easy assembly into a triangular shipping container and a method for preparing the same.

2. Description of the Related Art

Triangular containers for shipping and storing various items are well known in the art. To conserve space and simplify handling, such containers are themselves typically shipped and stored in the form of unassembled planar blanks that must be folded and glued, taped, and/or stapled to produce complete, assembled containers. Assembly of a container often requires numerous portions of a blank to be folded and fastened together, which can be time consuming and labor intensive. This folding and fastening of the prior art blanks is ordinarily entirely performed immediately before the object to be shipped is placed in them by the user. If the blanks were folded by their manufacturer before being packaged and shipped to the user, the blanks become bulky and therefore inefficient and more expensive to package, inventory and ship.

It would therefore be desirable to have a shipping container blank that is substantially planar so it can be compactly and efficiently packaged and stored before use but additionally is constructed in a way that reduces the amount of folding and fastening manipulations that the user must perform in order to assemble it into a triangular shipping container.

BRIEF SUMMARY OF THE INVENTION

The present invention relates to a pre-configured shipping container blank that can be assembled into a triangular shipping container quickly and with relatively little effort.

In accordance with the preferred embodiment of the present invention, there is provided a container blank that is preferably formed of a material commonly called cardboard but more accurately is called corrugated fiberboard or corrugated paperboard.

The container blank has a rectangular base panel, a rectangular rear panel foldably connected to the rectangular base panel along a first longitudinal fold line, and a rectangular front panel foldably connected to the rectangular base panel along a second longitudinal fold line opposite the first longitudinal fold line. Preferably, a closure tab is foldably connected to the front panel along a third longitudinal fold line opposite the second longitudinal fold line.

An end section is formed at each end of the blank and each comprises two triangular panels and preferably an additional "mounting" panel. A first triangular panel is foldably connected to the base panel along a first transverse fold line. A second triangular panel is foldably connected to the first triangular panel along a first angled fold line and is foldably connected to the interior surface of the rear panel along a second angled fold line. A third triangular panel is foldably connected to the base panel along a second transverse fold line opposite the first transverse fold line. A fourth triangular panel is foldably connected to the third triangular panel along a third angled fold line and is foldably connected to the interior surface of the rear panel along a fourth angled fold line.

Preferably, the way of foldably connecting the second and fourth triangular panels to the interior surface of the rear panel along a second angled fold line is to connect each of these two triangular panels to its own mounting panel that is mounted to the surface of the rear panel. Specifically, a first mounting panel is foldably connected to the second triangular panel along the second angled fold line and is flatly mounted to the interior surface of the rear panel for foldably connecting the second triangular panel to the interior surface of the rear panel along the second angled fold line. Similarly, a second mounting panel is preferably foldably connected to the fourth triangular panel along the fourth angled fold line and is flatly mounted to the interior surface of the rear panel for foldably connecting the fourth triangular panel to the interior surface of the rear panel along the fourth angled fold line. The preferred manner of flatly mounting the mounting panels to the interior surface of the rear panel is by the application of an adhesive.

By mounting these panels as described above before shipping, the blanks are essentially planar for compact storing, packaging and shipping, but are very easily and quickly assembled. By folding the longitudinal section of the blank along the longitudinal fold lines, the end sections of the blank are caused to automatically fold along the angled fold lines to form a triangular shipping container. The container can thereafter be fastened shut by folding the closure tab along the third longitudinal fold line and affixing the tab to the exterior of the container with glue, tape, or similar fastening means.

BRIEF DESCRIPTION OF THE SEVERAL VIEWS OF THE DRAWINGS

FIG. 2*a* is a partial front view illustrating a pre-folded and pre-glued end of the preferred embodiment of the present invention shown in FIG. 1.

FIG. 2*b* is a partial view in perspective illustrating the end of the preferred embodiment of the present invention shown in FIG. 2.

FIG. 4*a* is a partial front view illustrating an unfolded end of an alternative embodiment of the present invention.

FIG. 4*b* is a partial view in perspective illustrating the end of the alternative embodiment shown in FIG. 4*a* wherein the end has been folded and fastened.

FIG. 5*a* is a partial front view illustrating an unfolded end of another alternative embodiment of the present invention.

FIG. 5*b* is a partial view in perspective illustrating the end of the alternative embodiment shown in FIG. 5*a* wherein the end has been folded and fastened.

FIG. 7*a* is a front view illustrating an alternative embodiment of the present invention wherein the closure tab has been omitted.

FIG. 7*b* is a perspective view illustrating a completed triangular container formed of the container blank of the alternative embodiment of the present invention shown in FIG. 7*a*.

Figure 1:
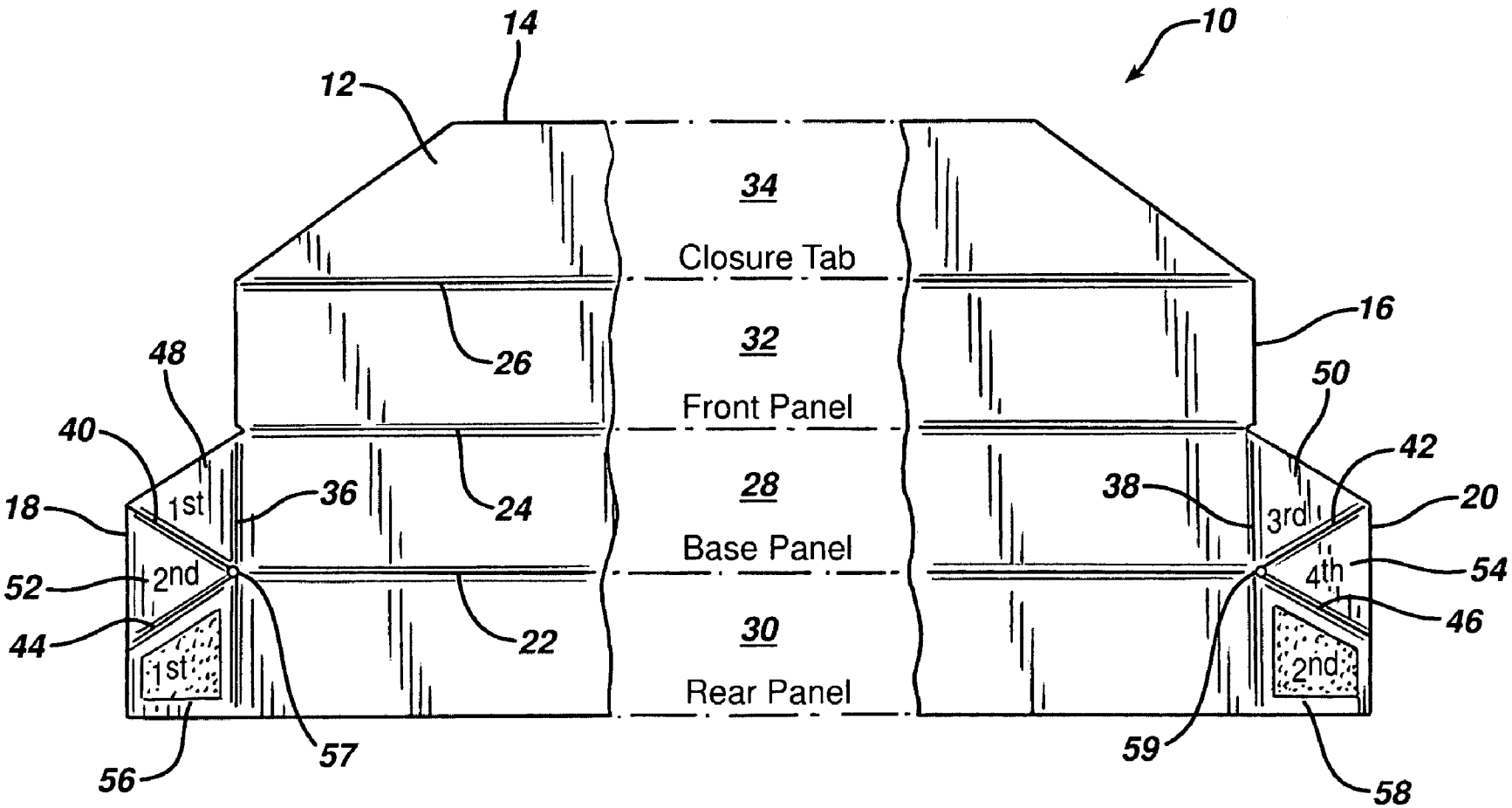
FIG. 1 is a front view illustrating the preferred embodiment of the present invention with the end sections shown unfolded for clarity.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used.

DETAILED DESCRIPTION OF THE INVENTION

Referring to FIG. 1, a shipping container blank 10 in accordance with the present invention is illustrated. The blank 10 is shown completely unfolded in FIG. 1 for clarity, and the blank 10 is shown in its inventive, pre-folded and pre-glued form (described in greater detail below) in FIGS. 2*a*-2*g*. It is preferred that the container blank 10 be formed of conventional corrugated fiberboard, although is contemplated that the blank 10 can be formed of any other material that is suitable for making a shipping container or point of purchase display, including, but not limited to folding carton stock, wood, metal, plastic, and various composites. For the sake of convenience and clarity, terms such as "top", "bottom", "length," "width," "inwardly," "outwardly," "lateral," and "longitudinal" will be used herein to describe the relative size and orientation of various components of the invention, all with respect to the geometry and orientation of the blank 10 as it appears in FIG. 1. This terminology will include the words specifically mentioned, derivatives thereof, and words of similar import.

The container blank 10 is generally planar with an interior surface 12 and an opposing exterior surface 14 (not within view). The blank 10 includes a longitudinal section 16 and two end sections 18 and 20. Three longitudinal fold lines 22, 24, and 26 are formed in the longitudinal section 16 of the blank 10 in a substantially parallel relationship for foldably separating the longitudinal section 16 into a base panel 28, a rear panel 30, a front panel 32, and a closure tab 34. The fold lines 22, 24, and 26 may be scored and/or depressed into the interior surface 12 of the blank 10 in a conventional manner that will be appreciated by those skilled in the art. The base panel 28, rear panel 30, and front panel 32 are generally rectangular in shape and are preferably equal to one another in dimension to form a container having an equilateral, triangular cross section (described in greater detail below). The longitudinal section 16 of the container blank 10 can have any length desired, as indicated by the broken lines in the longitudinal section 16, although lengths under about 6 feet are generally preferred for forming a container with sufficient axial rigidity. Container blanks formed of materials other than fiberboard may, however, offer sufficient axial rigidity at maximum lengths greater or lesser than that of the preferred embodiment. It is generally required that the panels 28-32 be of substantially equal length, although embodiments of the invention are contemplated in which the panels 28-32 have unequal widths for forming triangular containers that are not equilateral.

The closure tab 34 is preferably trapezoidal in shape and has a width that is substantially equal to the widths of the base, rear, and front panels 28-32. However, the closure tab 34 can have any suitable size or shape, including, but not limited to rectangular, triangular, or rounded. Alternatively, the closure tab 34 can be replaced by two or more smaller tabs that are longitudinally spaced apart from another. The closure tab 34 can alternatively be foldably connected to the rear panel, as indicated by the phantom line shown in FIG. 7*a*. Still further, the closure tab can be entirely omitted (see FIGS. 7*a* and 7*b*).

Still referring to FIG. 1, first and second transverse fold lines 36 and 38 are formed in the container blank 10 in a substantially parallel relationship at opposing longitudinal ends of the longitudinal section 16. The transverse fold lines 36 and 38 foldably separate the longitudinal section 16 of the blank 10 from the end sections 18 and 20 and allow the end sections 18 and 20 to be folded approximately 180 degrees relative to the interior surface of the longitudinal section 16.

A first angled fold line 40 and a second angled fold line 44 are formed in the end section 18 for foldably separating the end section 18 into a first triangular panel 48, a second triangular panel 52, and a first mounting panel 56. Similarly, a third angled fold line 42 and a fourth angled fold line 46 are formed in the end section 20 for foldably separating the end section 20 into a third triangular panel 50, a fourth triangular panel 54, and a second mounting panel 58.

It is critical that the edges of the first and third triangular panels 48 and 50 that lie along the first and second transverse fold lines 36 and 38 extend from the top edge of the base panel 28 to the bottom edge of the base panel 28. It is generally preferred that the first and third triangular panels 48 and 50 be equilateral, with each edge of the panels 48 and 50 being substantially equal in length to the widths of the base, front, and, rear panels 28-32 for forming an assembled shipping container with an equilateral cross-section. While the lengths of the edges of the first and third triangular panels 48 and 50 can be made unequal for forming a triangular container that is not equilateral, it is generally required that the lengths of the top edges of the panels 48 and 50 be substantially equal to the width of the front panel 32, that the lengths of the bottom edges of the panels 48 and 50 be substantially equal to the width of the rear panel 30, and that the lengths of the edges of the panels 48 and 50 that lie along the first and second transverse fold lines 36 and 38 be substantially equal to the width of the base panel 28.

The second and fourth triangular panels 52 and 54 are preferably identical in size and shape to the first and third triangular panels 48 and 50, although it is contemplated that the edges of the second and fourth triangular panels 52 and 54 that lie along the first and third angled fold lines 40 and 42 can be shorter than the edges of the first and third triangular panels 48 and 50 that lie along the first and third angled fold lines 40 and 42 and that the edges of the second and fourth triangular panels 52 and 54 that lie along the second and fourth angled fold lines 44 and 46 can be longer or shorter than the edges of the first and third triangular panels 48 and 50 that lie along the second and fourth angled fold lines 44 and 46. The outermost edges of the second and fourth triangular panels 52 and 54 can alternatively be rounded, notched, or irregularly-shaped.

The first and second mounting panels 56 and 58 are preferably trapezoidal in shape and extend downwardly from the second and fourth angled fold lines 44 and 46 to the bottom edge of the rear panel 30. The first and second mounting panels 56 and 58 can have a variety of other shapes and sizes, as will be discussed later herein. Preferably, relief holes 57 and 59 are formed through each of the end sections 18 and 20 at the intersection of the three panels that make up an end section. These holes make is easier to fold the material along the fold lines.

Referring now to FIGS. 2*a* and 2*b*, the container blank 10 is shown in its inventive, pre-folded and pre-glued form. The end sections 18 and 20 of the blank 10 are substantially identical minor images of one another, and will now be described with reference to the left end section 18 only. It is a first critical feature of the invention that the end section 18 of the blank 10 is folded inwardly, with the interior surface of the end section 18 flatly abutting the interior surface of the longitudinal section 16. It is another critical feature of the invention that the bottom edge of the second triangular panel 52 is foldably secured against the interior surface of the rear panel 30 for allowing the second triangular panel 52 to fold approximately 180 degrees relative to the rear panel 30 about the second angled fold line 44. In the preferred embodiment of the invention, both of the above described critical features are achieved by gluing the interior surface of the first mounting panel 56 to the interior surface of the rear panel 30 (glue is indicated by the dashed trapezoidal outlines in FIGS. 2*a* and 2*b*, and by the shaded trapezoids in FIG. 1). Although it is preferred that the interior surfaces of the first mounting panel 56 and the rear panel 30 be glued together, the panels 56 and 30 can be secured to one another by any other conventional means, such as by taping, stapling, or by Velcro.

Figure 2C:
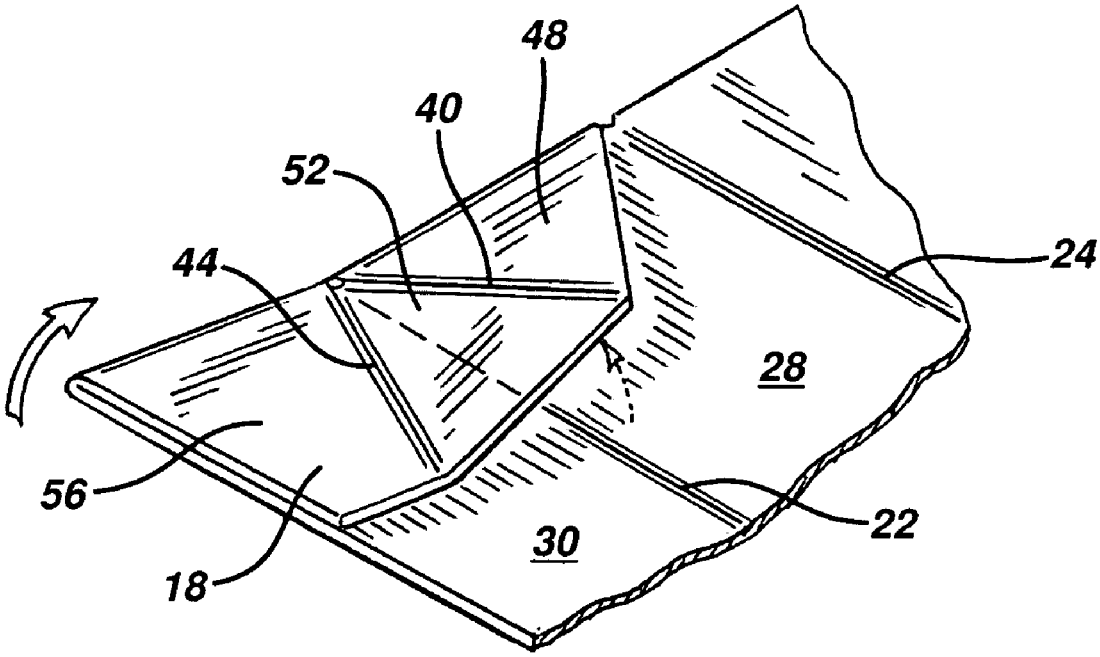
FIGS. 2*c*-2*g* are partial views in perspective illustrating the progressive folding of the end section of the preferred embodiment of the present invention shown in FIG. 2.
Figure 2D:
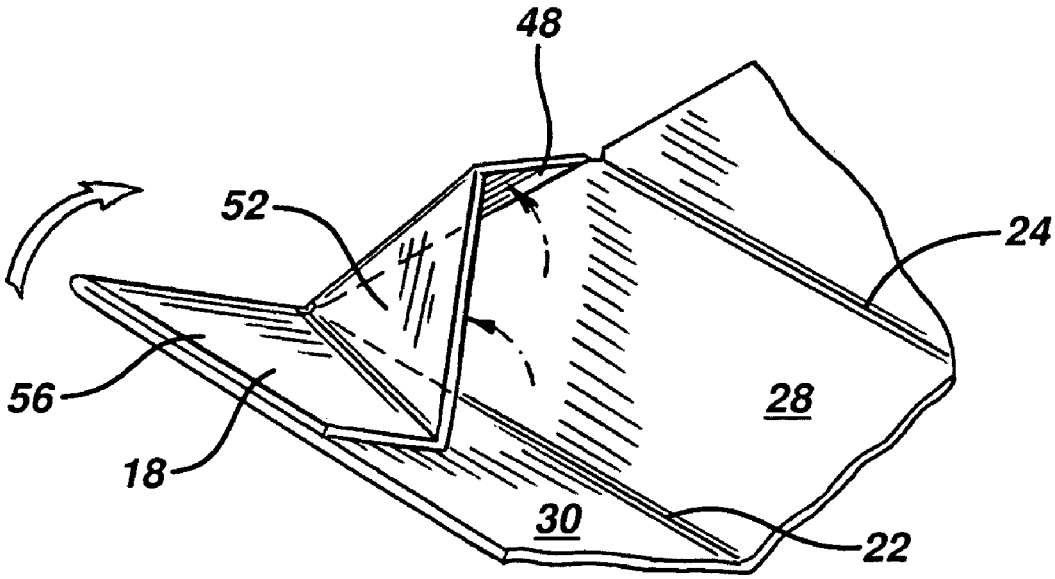
Figure 2E:
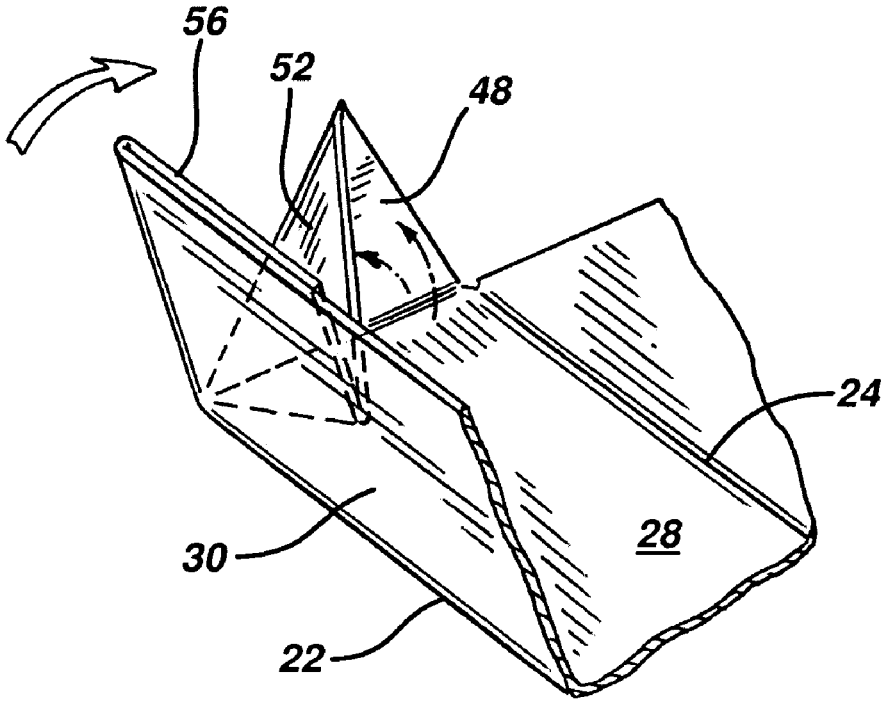

Container blanks are stacked and packaged with both of their end sections folded and secured as illustrated in FIGS. 2*a* and 2*b*. In order to convert the pre-folded, pre-glued container blank 10 into an assembled shipping container, the blank 10 must be folded along the first and second longitudinal fold lines 22 and 24 as indicated by the curved, outlined arrows shown in FIGS. 2*c*-2*e*. Referring to FIGS. 2*c*-2*f*, the rear panel 30 is preferably first folded inwardly about the first longitudinal fold line 22 toward the interior surface of the base panel 28. As the rear panel 30 is pivoted, the end section 18 of the blank 10 is caused to automatically fold along the first and second angled fold lines 40 and 44 in the manner of a pop-up book, as indicated by the dashed arrows in FIGS. 2*c*-2*e*. Specifically, the exterior surface of the first mounting panel 56 automatically pivots about the second angled fold line 44 toward the exterior surface of the second triangular panel 52, and the interior surface of the second triangular panel 52 automatically pivots about the first angled fold line 40 toward the interior surface of the first triangular panel 48. The first triangular panel 48 is thereby caused to automatically pivot about the first transverse fold line 36 outwardly, away from the base panel 28.

Figure 2F:
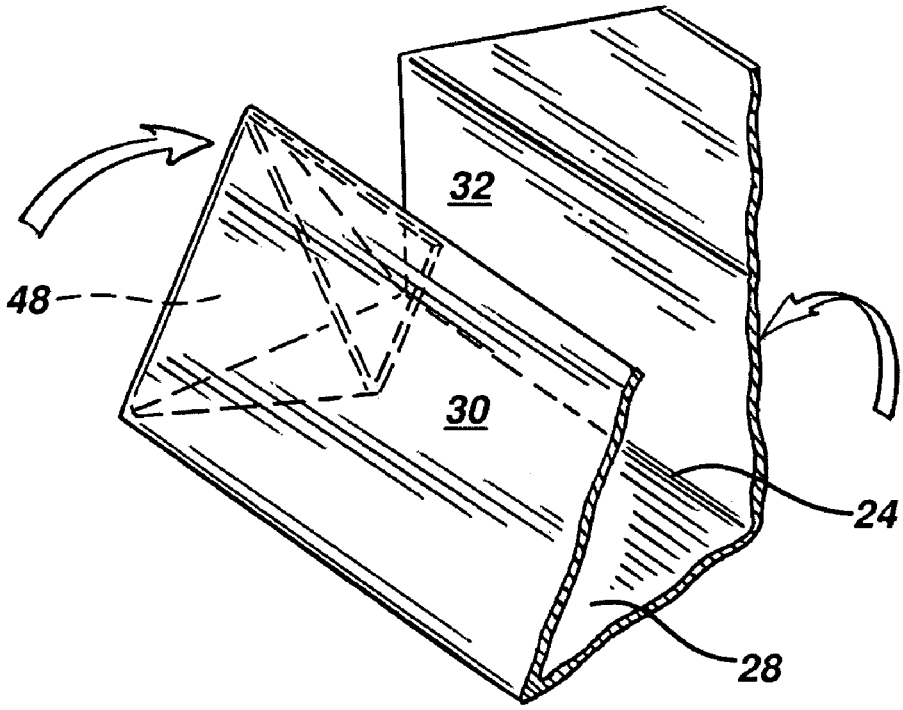

Referring to FIG. 2*f*, the rear panel 30 is folded until the lateral edge of the rear panel 30 meets the bottom edge of the first triangular panel 48. Optionally, the exterior surfaces of the mounting panel 56 and the second triangular panel 52 may then be fastened together with glue, tape, staples, or any other suitable fastening means. At this point, any items that are to be stored or shipped in the container should be placed inside the assembled portion of the container (i.e., within the V-shaped crotch formed by the base panel 28 and the rear panel 30).

Figure 2G:
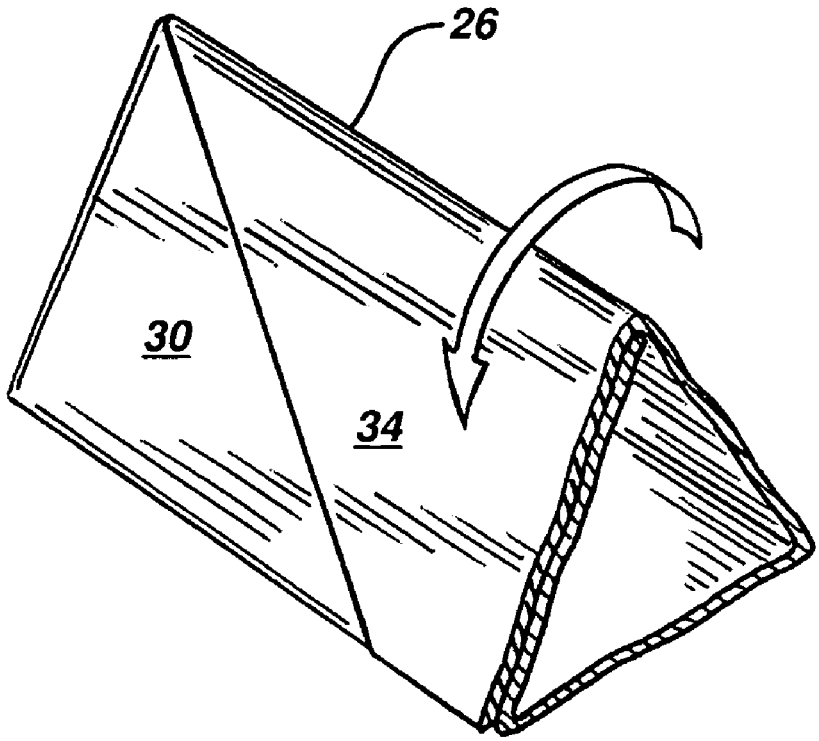
Figure 3:
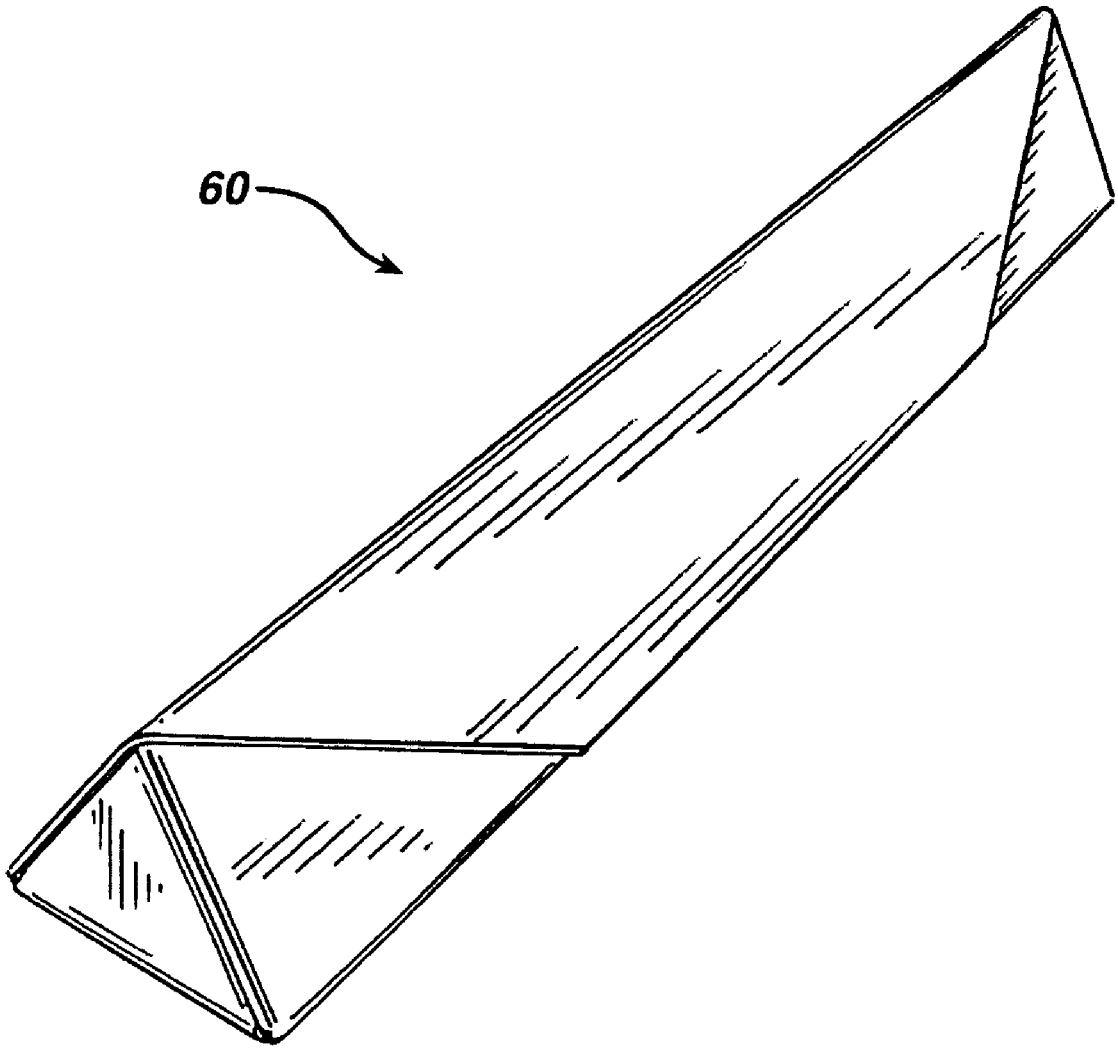
FIG. 3 is a perspective view illustrating a completed triangular container formed of the container blank of the preferred embodiment of the present invention shown in FIG. 1.

Referring now to FIGS. 2*f* and 2*g*, the assembly of the shipping container is completed by pivoting the front panel 32 about the second longitudinal fold line 24 toward the base panel 28 until the lateral edge of the front panel 32 meets the top edge of the first triangular panel 48. Referring to FIG. 2*g*, the closure tab 34 is then folded about the third longitudinal fold line 26 over the rear panel 30 until the interior surface of the closure tab 34 is brought into contact with the exterior surface of the rear panel 30. The closure tab 34 is then preferably fastened to the rear panel 30 with glue, although all other suitable fastening means, such as tape, staples, or Velcro, are contemplated. Referring to FIG. 3, the completed triangular shipping container 60 is sealed and ready to be shipped.

Figure 6A:
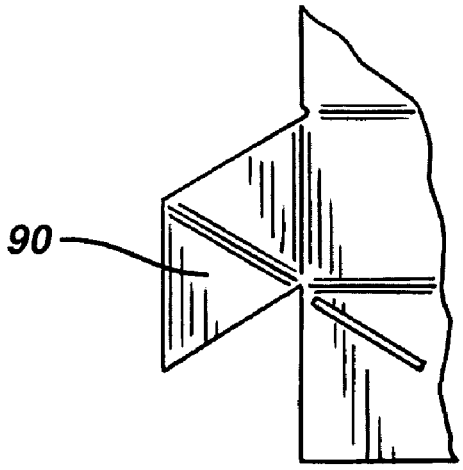
FIG. 6*a* is a partial front view illustrating an unfolded end of another alternative embodiment of the present invention.
Figure 6B:
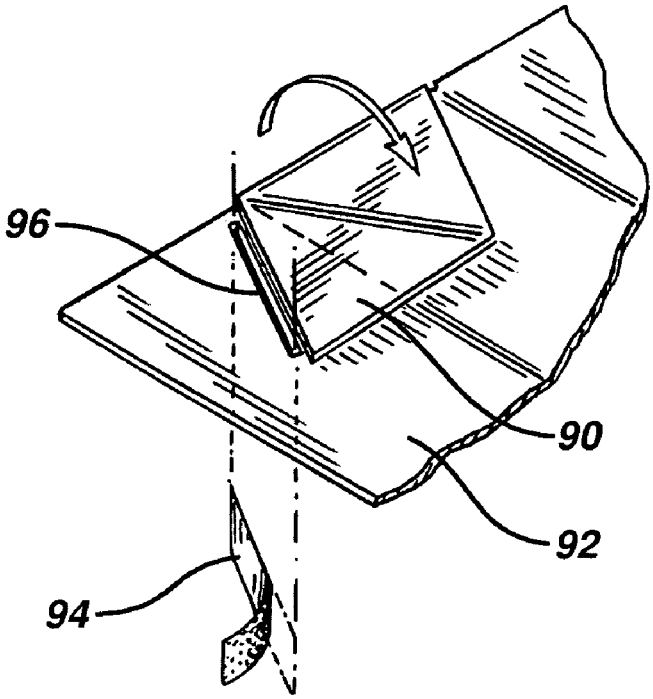
FIG. 6*b* is a partial view in perspective illustrating the end of the alternative embodiment shown in FIG. 6*a* wherein the end has been folded.
Figure 6C:
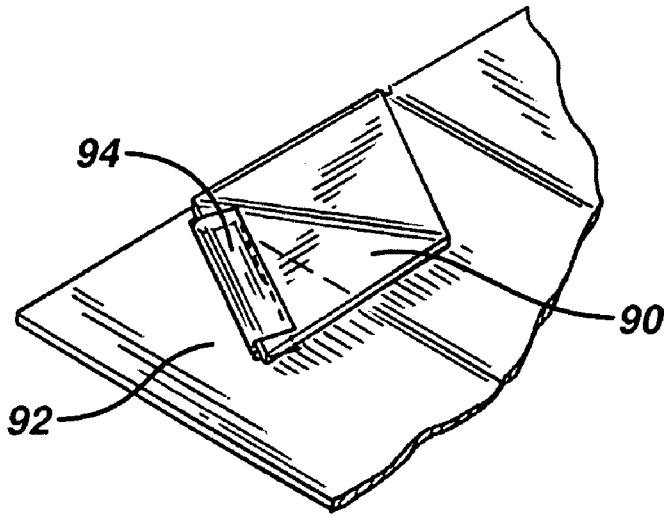
FIG. 6*c* is a partial view in perspective illustrating the end of the alternative embodiment shown in FIG. 6*a* wherein the end has been folded and fastened.

Although it is preferred that the first mounting panel 56 be trapezoidal in shape and that it extends from the second angled fold line 44 to the bottom edge of the rear panel 30, the first mounting panel 56 can have a variety of alternative shapes and sizes, or it can be omitted entirely. For example, referring to FIGS. 4*a* and 4*b*, the left end section of an alternative embodiment of the invention is illustrated in which the mounting panel 70 is a narrow tab. Referring to FIGS. 5*a* and 5*b*, another embodiment of the invention is illustrated in which the mounting panel is omitted, and wherein the bottom edge of the second triangular panel 80 is foldably secured against the rear panel 82 with a piece of tape 84. Referring now to FIGS. 6*a*-6*c*, yet another embodiment of the invention is illustrated wherein the mounting panel is omitted, and wherein the exterior surface of the second triangular panel 90 is foldably connected to the exterior surface of the rear panel 92 by a piece of tape 94 that extends through a narrow slit 96 formed in the rear panel 92. Although the embodiment illustrated in FIGS. 6*a*-6*c* is not preferred because it lacks the strength of the preferred embodiment, it is included to show that many different methods for foldably connecting the second triangular panel 52 to the rear panel 30 are possible.

If the closure tab 34 is omitted, as in the embodiment of the invention shown in FIGS. 7*a* and 7*b*, one or more pieces of tape 100 or any other suitable fastener can be used to fasten the exterior surface of the front panel 102 to the exterior surface of the rear panel 104 for holding the assembled container 106 closed. As a further alternative, a closure tab 108, similar to the closure tab 34, may optionally be hinged along a fold line to the rear panel 110.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A substantially planar, partially assembled, triangular shipping container comprising:

(a) a rectangular base panel;

(b) a rectangular rear panel foldably connected to said rectangular base panel along a first longitudinal fold line and having an interior surface for facing an interior of an assembled container;

(c) a rectangular front panel foldably connected to said rectangular base panel along a second longitudinal fold line opposite the first longitudinal fold line;

(d) a first triangular panel foldably connected to the base panel along a first transverse fold line;

(e) a second triangular panel foldably connected to the first triangular panel along a first angled fold line and foldably connected to the interior surface of the rear panel along a second angled fold line;

(f) a third triangular panel foldably connected to the base panel along a second transverse fold line opposite the first transverse fold line;

(g) a fourth triangular panel foldably connected to the third triangular panel along a third angled fold line and foldably connected to the interior surface of the rear panel along a fourth angled fold line;

(h) said first and third triangular panels each including a free side edge opposite said first angled fold line and said third angled fold line, respectively;

(i) a first mounting panel foldably connected to the second triangular panel along the second angled fold line and flatly mounted to the interior surface of the rear panel for foldably connecting the second triangular panel to the interior surface of the rear panel along the second angled fold line; and (j) a second mounting panel foldably connected to the fourth triangular panel along the fourth angled fold line and flatly mounted to the interior surface of the rear panel for foldably connecting the fourth triangular panel to the interior surface of the rear panel along the fourth angled fold line wherein said shipping container is adapted to be stacked and packaged with another similar container for conveniently storing and transporting the shipping containers while allowing each shipping container to be fully assembled with a minimal amount of effort prior to its use.

2. The shipping container blank in accordance with claim 1, further comprising a closure tab foldably connected to the front panel along a third longitudinal fold line opposite the second longitudinal fold line.

3. The shipping container blank in accordance with claim 1, further comprising a closure tab foldably connected to the rear panel along a third longitudinal fold line opposite the first longitudinal fold line.

4. A method for preparing shipping container blanks into partially assembled shipping containers that are substantially planar and compactly packaged for storage and shipping before use but also reducing the amount of folding and fastening manipulations that a user must perform in order to assemble the shipping containers, the method comprising:

(a) forming a plurality of shipping container blanks, each blank having a longitudinal section and two end sections, one end section connected to an end of the longitudinal section by a first transverse fold line and the other end section connected at the opposite end of the longitudinal section by a second transverse fold line, (i) the longitudinal section having a rectangular base panel, a rectangular rear panel foldably connected to said rectangular base panel along a first longitudinal fold line, and a rectangular front panel foldably connected to said rectangular base panel along a second longitudinal fold line opposite the first longitudinal fold line, (ii) one end section having a first triangular panel foldably connected to the base panel along the first transverse fold line, a second triangular panel foldably connected to the first triangular panel along a first angled fold line, and a first mounting panel foldably connected to the second triangular panel along a third angled fold line, (iii) the other end section having a third triangular panel foldably connected to the base panel along the second transverse fold line opposite the first transverse fold line, a fourth triangular panel foldably connected to the third triangular panel along a second angled fold line, and a second mounting panel foldably connected to the fourth triangular panel along a fourth angled fold line;

(iv) said first and third triangular panels each including a free side edge opposite said first angled fold line and said second angled fold line, respectively;

(b) folding the end sections inwardly with the interior surfaces of the end sections flatly abutting the interior surface of the longitudinal section;

(c) flatly mounting and securing the first mounting panel to an interior surface of the rear panel for foldably connecting the second triangular panel to the interior surface of the rear panel along the third angled fold line and flatly mounting and securing the second mounting panel to the interior surface of the rear panel for foldably connecting the fourth triangular panel to the interior surface of the rear panel along the fourth angled fold line; and (d) stacking and packaging the partially assembled shipping containers with their end sections folded and secured.

5. The method in accordance with claim 4, wherein the first mounting panel is flatly mounted to the interior surface of the rear panel by applying adhesive to the first mounting panel and placing the first mounting panel in flat engagement with the interior surface of the rear panel, and wherein the second mounting panel is flatly mounted to the interior surface of the rear panel by applying adhesive to the second mounting panel and placing the second mounting panel in flat engagement with the interior surface of the rear panel.

* * * * *